US007162940B2

(12) United States Patent
Rizzoli et al.

(10) Patent No.: US 7,162,940 B2
(45) Date of Patent: Jan. 16, 2007

(54) UNIT FOR PREPARING LEAVES OF PAPER MATERIAL

(75) Inventors: Salvatore Rizzoli, Bologna (IT); Fiorenzo Draghetti, Bologna (IT)

(73) Assignee: G.D S.p.A., Bologna (IT)

( * ) Notice: Subject to any disclaimer, the term of this patent is extended or adjusted under 35 U.S.C. 154(b) by 0 days.

(21) Appl. No.: 10/679,316

(22) Filed: Oct. 7, 2003

(65) Prior Publication Data

US 2004/0123710 A1 Jul. 1, 2004

(30) Foreign Application Priority Data

Oct. 17, 2002 (IT) ..... BO2002A0656

(51) Int. Cl.
*B65H 35/08* (2006.01)
*B65H 23/04* (2006.01)

(52) U.S. Cl. ..... 83/175; 131/91

(58) Field of Classification Search ..... 83/175, 83/18, 100, 345, 346; 131/91, 93, 95; 242/522, 242/523, 523.1, 487.1, 487.2, 487.5, 487.9, 242/488, 417, 416; 226/95
See application file for complete search history.

(56) References Cited

U.S. PATENT DOCUMENTS 3,174,372 A * 3/1965 Huck ..... 83/110
3,651,724 A * 3/1972 Huffman ..... 83/24
4,608,115 A * 8/1986 Schroth et al. ..... 156/519
4,614,198 A 9/1986 Hinchcliffe et al.
4,811,641 A * 3/1989 Muller ..... 83/105
5,222,422 A * 6/1993 Benner et al. ..... 83/37
5,363,728 A * 11/1994 Elsner et al. ..... 83/23

FOREIGN PATENT DOCUMENTS

EP 1097894 5/2001
GB 1555443 11/1979

* cited by examiner

*Primary Examiner*—Stephen Choi
(74) *Attorney, Agent, or Firm*—Timothy J. Klima

(57) ABSTRACT

Tipping papers are cut from a continuous strip of material advancing along a set feed path by a unit comprising a suction roller and a roller equipped with blades, which combine to separate the single papers from the strip at a prescribed frequency; the tension of the advancing strip is varied cyclically by diverter elements associated with the suction roller and capable of movement at intervals coinciding with the frequency of the cutting stroke between two limit positions, one located externally and the other internally of the outer surface presented by the suction roller.

12 Claims, 4 Drawing Sheets

UNIT FOR PREPARING LEAVES OF PAPER MATERIAL

BACKGROUND OF THE INVENTION

The present invention relates to a unit for preparing leaves of paper material.

The invention finds application to advantage in cigarette making machines, and in particular filter tip attachments by which single tipping papers are cut from a continuous strip decoiled from a roll; reference is made explicitly to this art field in the following specification, albeit implying no limitation in general scope.

Filter tipped cigarettes are assembled generally by interposing a double length filter plug between two axially aligned cigarette sticks, then joining the filter to the sticks on either side by affixing a previously gummed tipping paper, and ultimately cutting the double assembly in half to create two single filter cigarettes.

Employing prior art methods, tipping papers are obtained from a continuous strip of paper material caused to advance along a predetermined feed path, first through a gumming device by which adhesive is applied to one face of the strip, and thereafter to a cutting device by which the strip is divided up into single leaves of predetermined length.

The cutting device operates downstream of the gumming device, relative to the direction followed by the advancing strip, and comprises two rollers contrarotating tangentially to one another about parallel axes, one with an aspirating surface by which the strip is drawn forward; each roller is equipped with respective blades arranged angularly at uniform pitch around its peripheral surface.

Each blade presented by one of the two rollers will interact typically with a corresponding blade of the other roller in such a way as to sever the strip along transverse lines, executing a so-called scissor cut. Accordingly, each blade of one roller combines with a blade of the other roller to create a scissor device which, when the rollers are driven in rotation, is designed to separate successive tipping papers by shearing point-to-point across the strip.

After the cut, the tipping papers are held on the surface of one of the two rollers, and more exactly the suction roller, before being transferred in succession to a station where each is offered to an aforementioned assembly composed of a double length filter plug and two cigarette sticks.

For the operation of joining the assemblies to be performed correctly, the tipping papers cut from the strip must be suitably distanced one from the next; this is accomplished by causing the suction roller to rotate at a peripheral speed greater than the linear speed of the advancing strip.

Because the scissor cut is generated by degrees, signifying that the separation of the single paper does not occur instantaneously but only after a given interval of time, the difference between the peripheral speed of the suction roller and the linear speed of the advancing strip prevents the papers being detached cleanly from the strip. As a result of the traction force exerted by the suction roller, in effect, the advancing strip is subjected to a pulling action which the narrowing portion of material gradually becomes unable to withstand as the final stage of the scissor cut is reached and tension in the uncut portion of the strip becomes excessive, so that the tipping paper separates by tearing, before a clean cut can be completed. The papers detached in this manner cannot therefore be utilized as they are marred by irregularities along the line of the cut at the point where the final separation occurs.

To overcome such drawbacks, prior art methods include the expedient of inserting a cyclically activated diverter between the gumming device and the cutting device, by which the tension of the strip is varied at intervals matching the stroke frequency of the cutting device. More exactly, the diverter serves to relax the tension of the strip during the cutting stroke With higher and higher strip feed speeds being adopted to accommodate increasingly fast production tempos, it can happen, due to the inherent elastic properties of the strip of paper material and the vibration generated by the diverter in the length of strip extending between the selfsame diverter and the cutting device, that the steps of relaxing the tension and making the cut will slip out of phase, and there is a risk of the material tearing along the final part of the cutting line.

The object of the invention is to provide a unit for preparing leaves of paper material such as will be unaffected by the aforementioned drawback.

SUMMARY OF THE INVENTION

The stated object is realized according to the present invention in a unit for preparing leaves of paper material from a continuous strip advancing along a predetermined feed path, equipped with cutting means such as will separate the leaves in succession from the strip at a selected cutting frequency utilizing a first aspirating roller and a second blade roller contrarotating substantially tangential one to another, also means associated with the first conveyor, by which the tension of the advancing strip can be varied cyclically and synchronously with the action of the cutting means. Such tension varying means incorporate diverter elements capable of cyclical movement generated synchronously with the cutting frequency between two limit positions, relative to the peripheral surface of the first conveyor.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
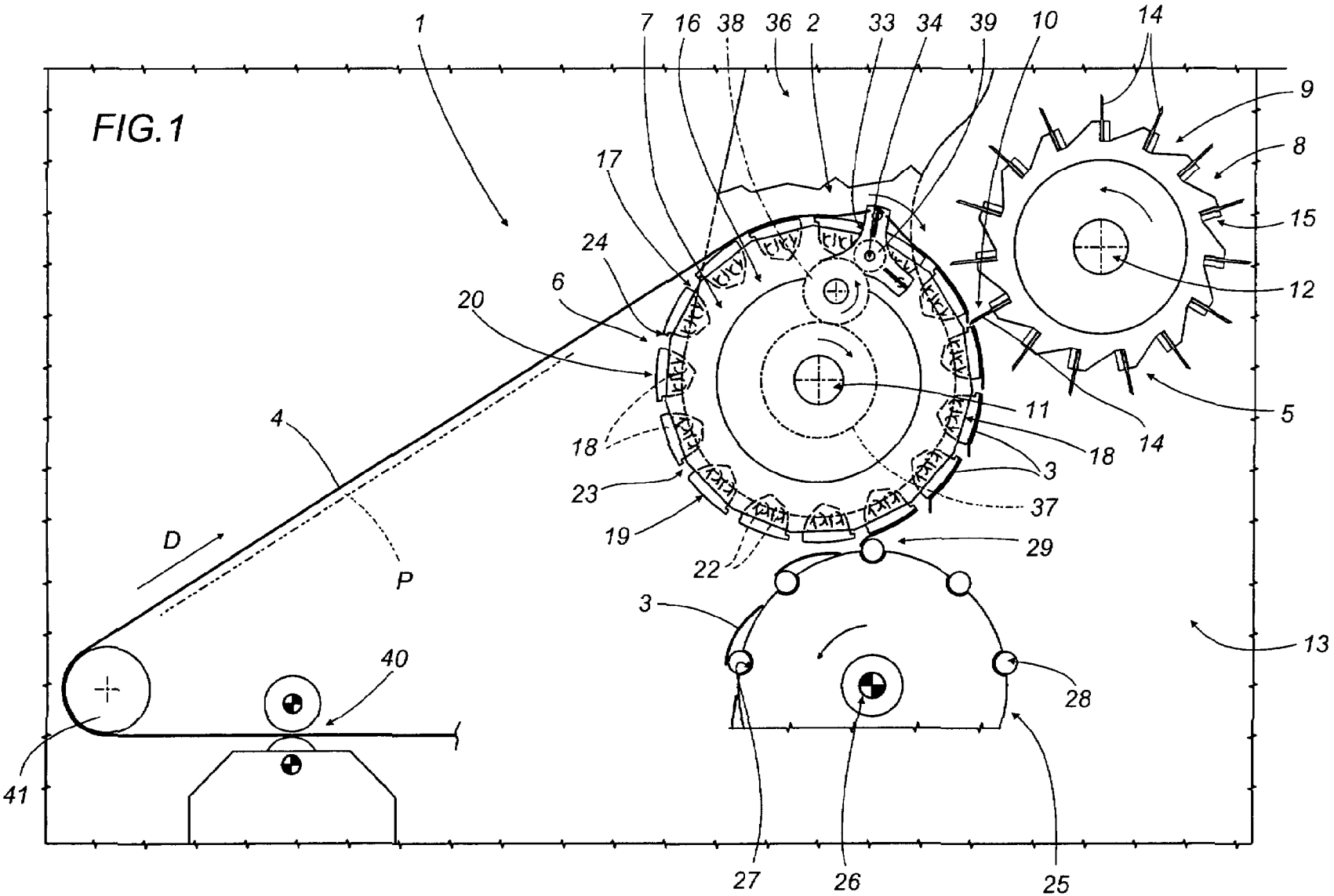
FIG. 1 illustrates a portion of a filter tip attachment equipped with a unit for preparing leaves of paper material embodied in accordance with the present invention, viewed schematically in a front elevation.
Figure 2:
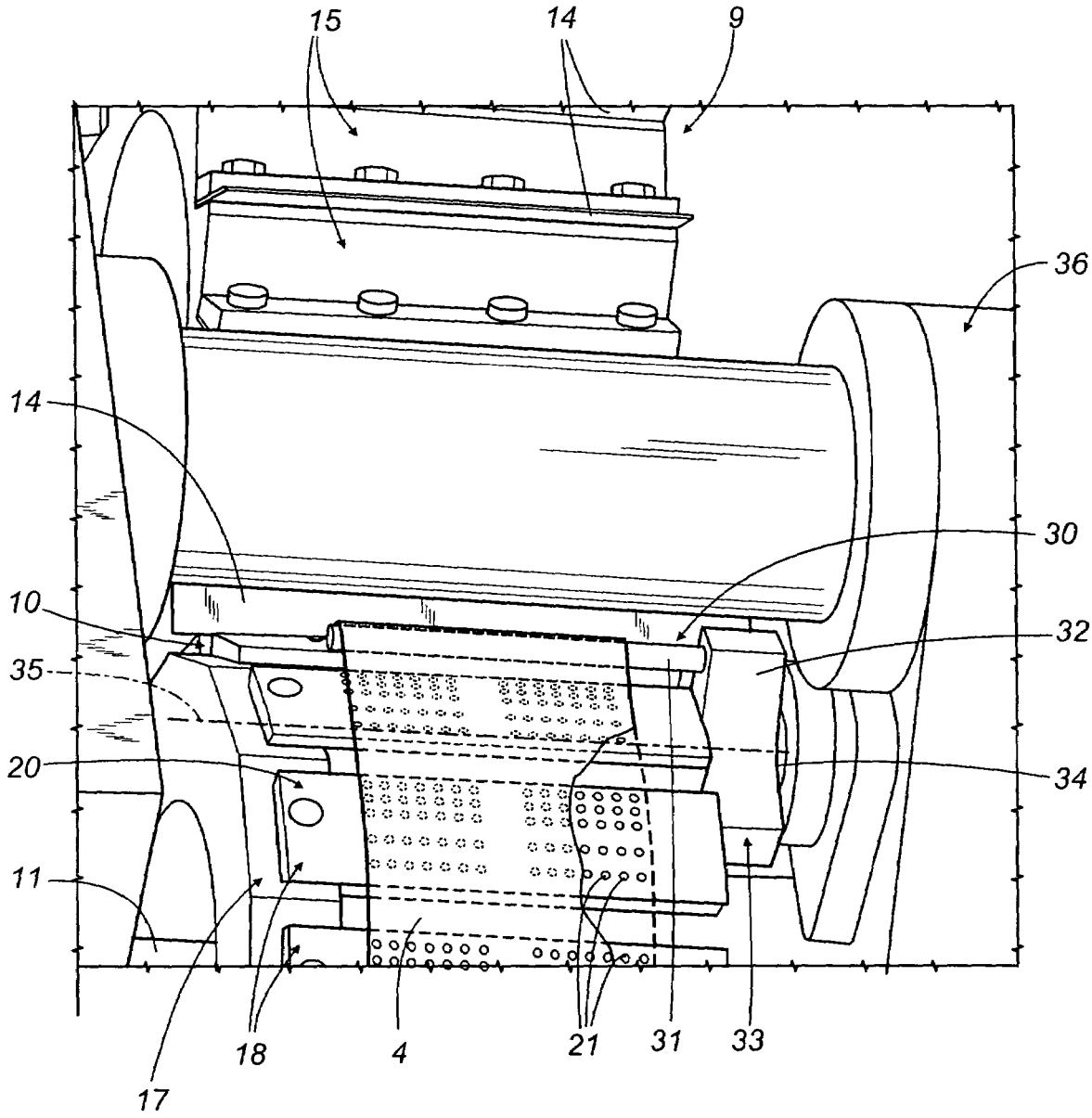
FIG. 2 illustrates an enlarged detail of the unit shown in FIG. 1, viewed in perspective.

Referring to FIGS. 1 and 2 of the accompanying drawings, 1 denotes a portion, in its entirety, of a cigarette maker, and in particular a filter tip attachment, comprising a unit 2 by means of which to prepare leaves 3 of paper material, or tipping papers, obtained from a continuous strip 4 caused to decoil from a relative bulk roll (not indicated) and advance along a predetermined feed path P in a direction denoted D, at a predetermined tension and linear speed.

As illustrated in FIG. 1, the unit 2 comprises cutting means 5 which in turn are composed of a first conveyor 6 consisting in a suction roller 7, and a second conveyor 8 consisting in a second roller 9 turning substantially tangential to the first at a station 10 where the strip 4 is divided into single leaves 3.

The rollers 7 and 9 are mounted to respective horizontal and mutually parallel shafts 11 and 12 carried in a frame 13 presented by the portion 1 of the cigarette maker and rotatable thus in opposite directions, turning clockwise and counterclockwise respectively as viewed in FIG. 1.

The second roller 9 carries a plurality of substantially radial blades 14 equispaced around and projecting from its peripheral surface 15, whilst the suction roller 7 comprises a disc 16 keyed onto the relative shaft 11 and furnished at the periphery 17 with a plurality of cantilevered aspirating sectors 18 equispaced angularly around the circumference and extending parallel to the axis of rotation of the roller 7, in such a way that the respective outer surfaces 19 of these same sectors 18 combine to create an outer cylindrical surface 20 that is set in rotation at a peripheral speed greater than the linear speed of the strip 9 advancing along the feed path P.

The outer surface 19 of each sector 18 presents a plurality of holes 21 connected in conventional manner by way of ducts 22, extending parallel with the shaft 11, to a source of negative pressure not illustrated in the drawings. The positioning of the sectors 18 around the periphery 17 of the disc 16, moreover, is such that each remains distanced from the next, with the result that the outer surface 20 of the roller 7 presents a plurality of gaps 23.

The outer surface 19 of each sector 18 presents a longitudinal corner edge 24 extending parallel to the axis of the first roller 7 and trailing in the direction of rotation, such as will combine with a corresponding blade 14 of the second roller 9 as it penetrates the relative gap 23 during the rotation of the rollers 7 and 9 and, when passing through the cutting station 10, establish a scissor device by which the continuous strip 4 is sheared across to generate a single leaf 3.

Still in FIG. 1, the filter tip attachment also comprises a roller 25 mounted to a shaft 26 lying parallel to the shafts 11 and 12 aforementioned, rotatable clockwise and furnished peripherally with grooves 27 each serving to accommodate a respective assembly 28 of two cigarette sticks separated by a double length filter plug, which is retained by suction in conventional manner; the assemblies 28 are caused to advance on the roller 25 transversely to their own axes through a transfer station 29 at which a tipping paper 3 is released by the suction roller 7 onto the outer surface of each successive assembly 28, whereupon the filters and cigarette sticks are joined together.

In the example of the accompanying drawings, the unit 1 further comprises means 30, associated with the suction roller 7, by which to vary the tension of the continuous strip 4. Such means 30 comprise diverter elements consisting in three cylindrical rods 31 extending parallel to the shaft 11 of the roller 7. Each rod 31 is supported at one end by one corresponding arm 32 of a flange 33 presenting three such arms 32 equispaced angularly at 120°.

The flange 33 is mounted to the projecting end of a shaft 34, rotatable about a relative axis 35 of which the position is fixed, extending parallel to the two roller shafts 11 and 12 and carried by a bulkhead 36 facing the frame 13 in such a way that the rods 31 extend from the flange 33 on the side of the roller 7 opposite to that occupied by the disc 16 supporting the aspirating sectors 18.

In other words, the aspirating sectors 18 and the cylindrical rods 31 are cantilevered from their supporting elements, namely the disc 16 and the flange 33, respectively, which occupy positions of mutual opposition on either side of the feed path P followed by the advancing strip 4.

The cylindrical rods 31 extend toward the disc 16 through a distance such that their free ends lie in close proximity to the disc and are able to revolve thus around the axis 35, which occupies a fixed position between the axis of the shaft 11 carrying the suction roller 7, and the outer surface 20 of this same roller 7. As discernible from FIG. 1, in particular, the shaft denoted 34 is coupled to the shaft 11 of the suction roller 7 by way of an interposed train of gears 37, 38 and 39 functioning also as means by which to adjust the timing between the rotation of the suction roller 7 and that of the tension varying means 30 in such a way that the three cylindrical rods 31 can be made to alternate cyclically and at the same frequency as the cutting means 5 between a first limit position radially behind the surface 20 of the suction roller 7 and a second limit position radially beyond the selfsame surface 20, by passing through the aforementioned gaps 23.

In operation, the continuous strip 4 advances at a predetermined linear speed along the feed path P through a gumming station 40 and a guide roller 41, ultimately reaching the outer surface 20 of the suction roller 7 which, in order to distance the leaves 3 separated at the cutting station 10, is caused to rotate at a peripheral speed greater than the linear speed of the advancing strip 4. This difference in speed causes the strip 4 positioned upstream of the cutting station 10 to slip on the outer surfaces 19 of the sectors 18, against which it is held by suction.

Figure 3:
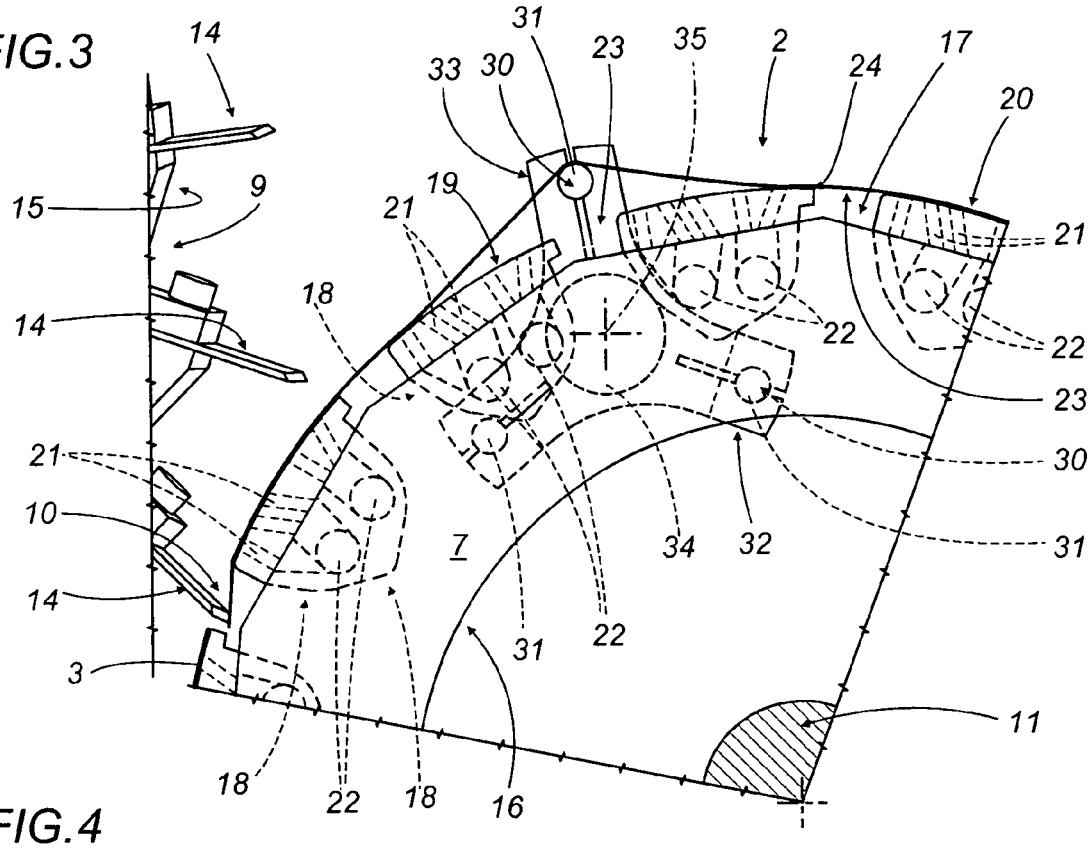
FIGS. 3 to 6 illustrate a detail of the unit of FIG. 1 in a sequence of operating steps.

It will be seen from FIGS. 1 and 3 that after a leaf 3 has been cut, and as the strip 4 advances a distance corresponding to the length of a further leaf 3, one of the rods 31 of the tension varying means 30, orbiting around the fixed axis 35 as the relative shaft 34 rotates synchronously with the suction roller 7, will pass through a gap 23 and assume the second limit position radially beyond the surface 20 of the suction roller 7 as indicated in FIG. 3. In this configuration, the strip 4 is engaged by the rod 31 and diverted from the feed path P, with the result that the length of the path is effectively increased and loop of strip 4 is formed around the rod 31.

Figure 4:
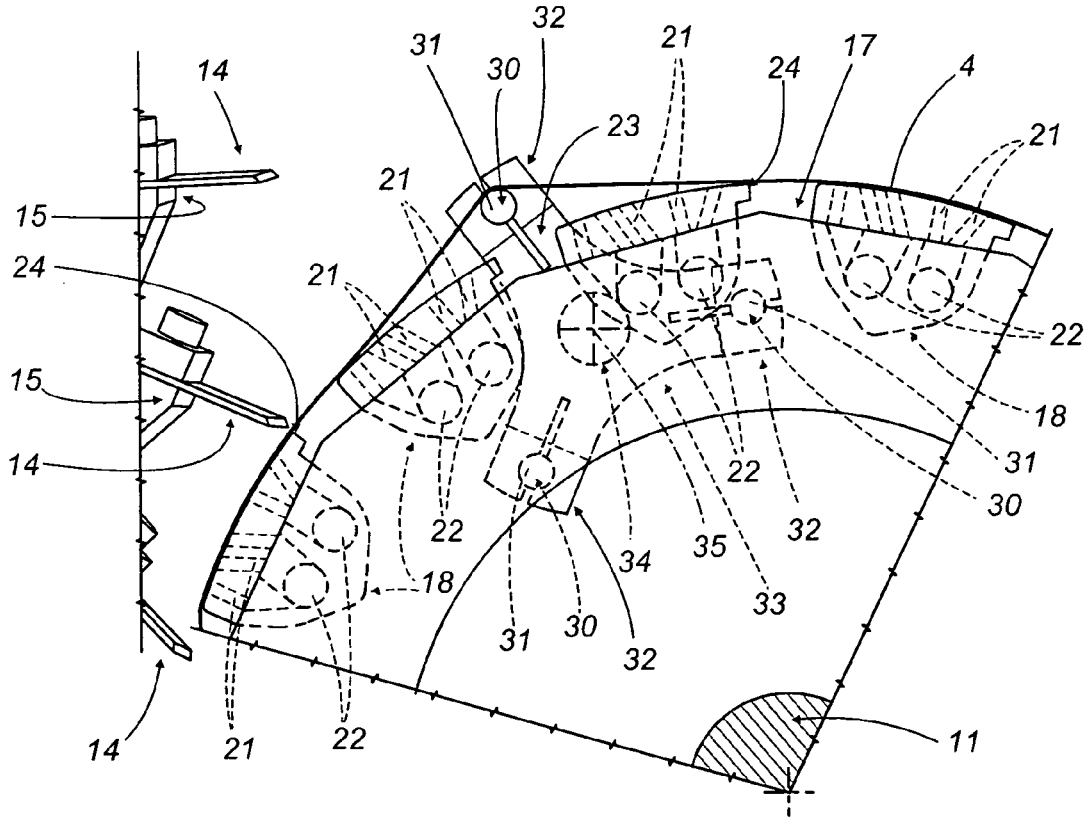
Figure 5:
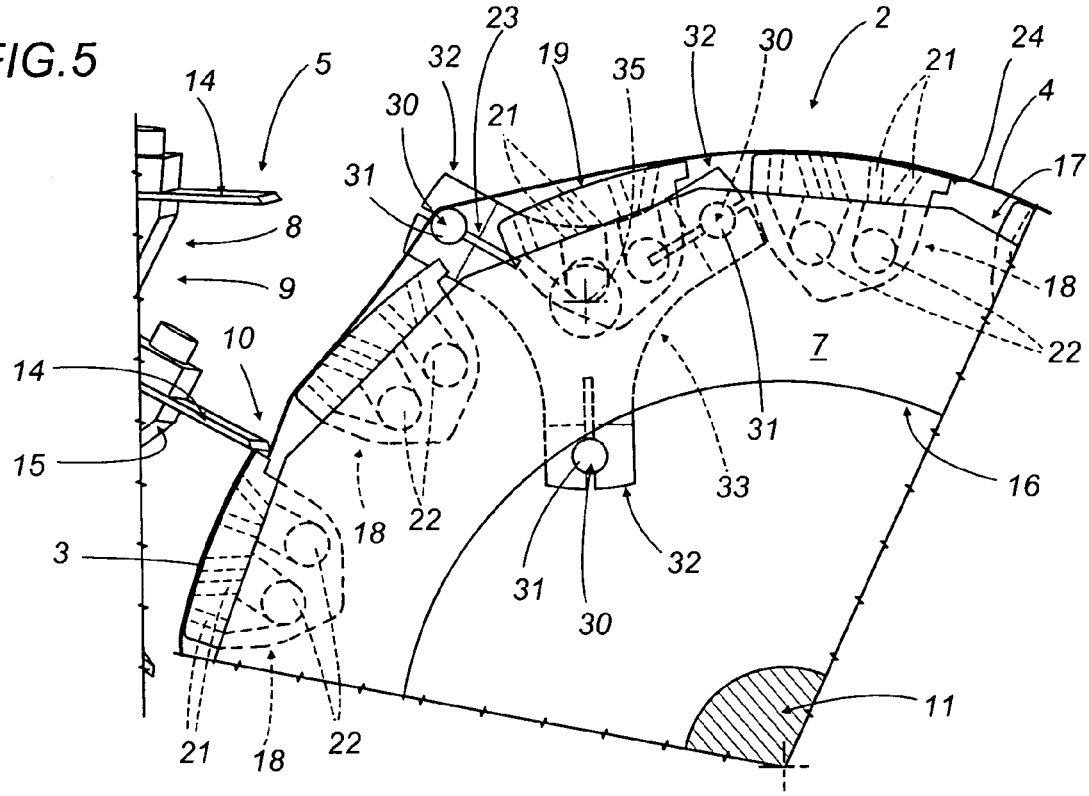
Figure 6:
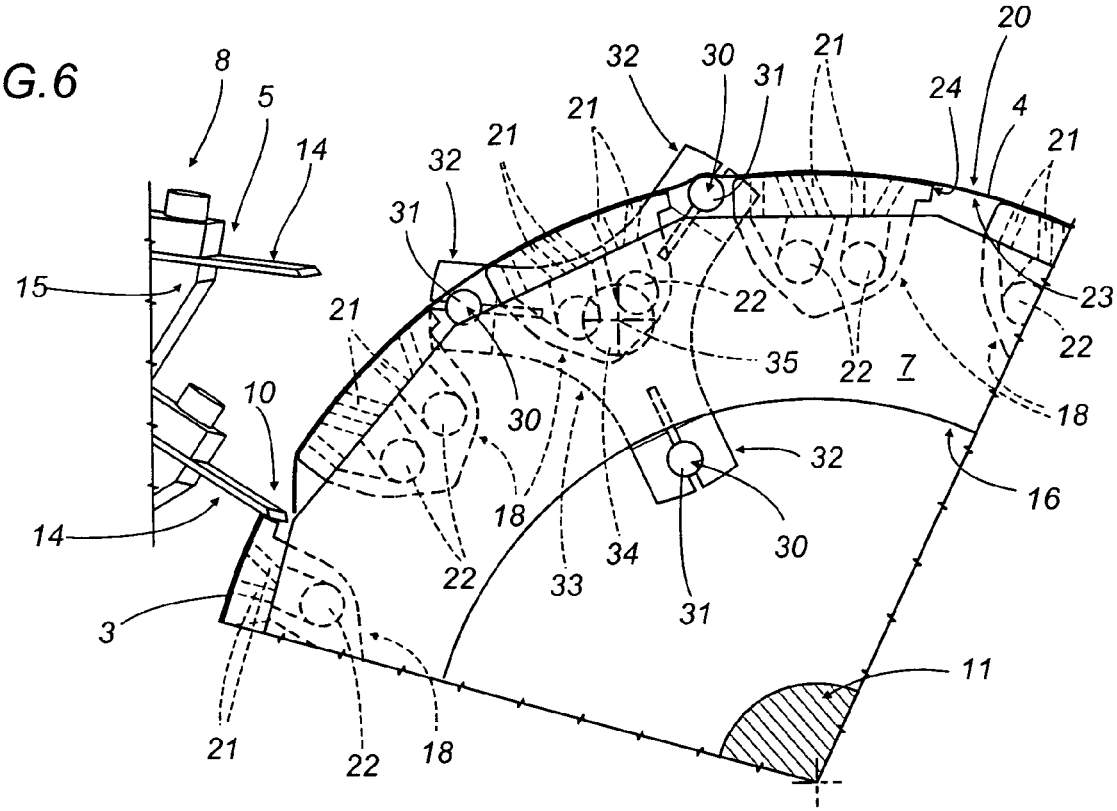

With the suction roller 7 continuing to rotate on its shaft 11 and the rod 31 continuing to revolve about the axis 35, as illustrated in the sequence of FIGS. 4 to 6, the rod 31 will be returned from the second limit position beyond the surface 20 of the roller 7 to the first limit position behind the selfsame surface. During this step, the slipping movement of the strip 4 against the surfaces 19 of the aspirating sectors 18 is practically eliminated as the loop formed initially over the rod 31 is gradually taken up, and the operation of preparing a further leaf 3, in which a blade 14 combines with the edge 24 of a corresponding sector 18 to make a scissor cut across the strip, is completed without tearing the paper material.

Thereafter, the next cylindrical rod 31 will pass through the next corresponding gap 23 to begin a new cycle, diverting the strip 4 in readiness for a further leaf 3 to be cut.

What is claimed is:

1. A unit for preparing leaves of paper material from a continuous strip caused to advance along a predetermined feed path, including:

a cutting mechanism, by which the leaves are separated in succession from the strip at a predetermined cutting frequency, comprising a first aspirating conveyor and a second conveyor substantially tangential to the first conveyor; the first aspirating conveyor comprising a first suction roller and an outer surface of the first suction roller being at least a portion of an outer surface of the first conveyor;

means for varying a tension of the strip cyclically and synchronously with the action of the cutting mechanism, capable of cyclical movement generated synchronously with the cutting frequency; the tension varying means comprising at least one diverter element revolving about a fixed axis parallel to an axis of the first conveyor between a first limit position radially below the surface of the suction roller and a second limit position radially beyond the surface of the suction roller.

2. A unit as In claim 1, wherein the fixed axis about which the diverter element revolves is positioned between an axis of the first suction roller and the outer surface of the first suction roller.

3. A unit as in claim 2, wherein the outer surface of the first suction roller is afforded by a plurality of cantilevered aspirating sectors arranged around a periphery of a supporting disc and separated one from the next by a uniform angular distance in such a way as to create a gap between each two adjacent sectors.

4. A unit as in claim 3, wherein the second conveyor comprises a second roller supporting a plurality of substantially radially aligned blades equispaced angularly around and projecting from the peripheral surface of the second roller.

5. A unit as in claim 4, wherein each aspirating sector presents a relative longitudinal corner edge extending parallel to the rotational axis of the first suction roller and combining with a corresponding blade of the second roller to scissor-cut the continuous strip.

6. A unit as in claim 5, wherein the tension varying means further comprises a shaft, rotatable about the fixed axis about which the diverter element revolves, of which a free end carries a flange located on a side of the first suction roller opposite from a disc carrying the aspirating sectors, wherein the flange carries a plurality of diverter elements comprising cylindrical rods disposed parallel to the fixed axis, projecting toward the disc and designed to pass cyclically through the gaps between adjacent sectors during the rotation of the first suction roller, as the shaft rotates about the fixed axis.

7. A unit as in claim 6, wherein the flange presents a substantially triangular configuration and carries one of the cylindrical rods at each vertex.

8. A unit as in claim 7, wherein the shaft carrying the flange is driven in rotation from a shaft carrying the disc of the first suction roller.

9. A unit as in claim 3, wherein the tension varying means further comprises a shaft, rotatable about the fixed axis about which the diverter element revolves, of which a free end carries a flange located on a side of the first suction roller opposite from a disc carrying the aspirating sectors, wherein the flange carries a plurality of the diverter elements comprising cylindrical rods disposed parallel to the fixed axis, projecting toward the disc and designed to pass cyclically through the gaps between adjacent sectors during the rotation of the first suction roller, as the shaft rotates about the fixed axis.

10. A unit as in claim 9, wherein the flange presents a substantially triangular configuration and carries one cylindrical rod at each vertex.

11. A unit as in claim 10, wherein the shaft carrying the flange is driven in rotation from a shaft carrying the disc of the first roller.

12. A unit for preparing leaves of paper material from a continuous strip caused to advance along a predetermined feed path, including:

a cutting mechanism, by which the leaves are separated in succession from the strip at a predetermined cutting frequency, comprising a first aspirating conveyor and a second conveyor substantially tangential to the first conveyor; the first aspirating conveyor comprising a first suction roller and an outer surface of the first suction roller being at least a portion of the outer surface of the first conveyor;

means for varying the tension of the strip cyclically and synchronously with the action of the cutting mechanism, capable of cyclical movement generated synchronously with the cutting frequency; the tension varying means comprising at least one diverter element revolving about a fixed axis parallel to an axis of the first conveyor between a first limit position radially behind the surface of the suction roller and a second limit position radially beyond the selfsame surface; the fixed axis about which the diverter element revolves is positioned between an axis of the first suction roller and the outer surface of the first suction roller; the outer surface of the first suction roller being afforded by a plurality of cantilevered aspirating sectors arranged around a periphery of a supporting disc and separated one from the next by a uniform angular distance in such a way as to create a gap between each two adjacent sectors; the tension varying means further comprising a shaft, rotatable about the fixed axis about which the diverter element revolves, of which a free end carries a flange located on a side of the first suction roller opposite from a disc carrying the aspirating sectors, wherein the flange carries a plurality of the diverter elements comprising cylindrical rods disposed parallel to the fixed axis, projecting towards the disc and designed to pass cyclically through the gaps between adjacent sectors during the rotation of the first suction roller, as the shaft rotates about the fixed axis.

* * * * *